United States Patent [19]

Kemmner et al.

[11] Patent Number: 4,466,781

[45] Date of Patent: Aug. 21, 1984

[54] ARRANGEMENT FOR FEEDING FUEL, PARTICULARLY FROM SUPPLY CONTAINER TO INTERNAL COMBUSTION ENGINE OF A POWER VEHICLE

[75] Inventors: Ulrich Kemmner, Stuttgart; Peter Ringwald, Rutesheim, both of Fed. Rep. of Germany

[73] Assignee: Robert Bosch GmbH, Stuttgart, Fed. Rep. of Germany

[21] Appl. No.: 424,981

[22] Filed: Sep. 27, 1982

[30] Foreign Application Priority Data

Jun. 24, 1982 [DE] Fed. Rep. of Germany ..... 3223515

[51] Int. Cl.[3] ..... F04B 35/04; F04D 5/00

[52] U.S. Cl. ..... 417/366; 417/423 R; 415/53 T; 415/213 T

[58] Field of Search ..... 417/366, 410, 423 R; 415/53 T, 213 T, 198.2

[56] References Cited

U.S. PATENT DOCUMENTS

| | | | |
|---|---|---|---|
| 3,315,607 | 4/1967 | MacInnes | 415/213 T |
| 3,418,991 | 12/1968 | Shultz et al. | 417/423 R X |
| 4,231,718 | 11/1980 | Ruhl et al. | 417/366 |
| 4,396,358 | 8/1983 | de Concini | 417/366 |

FOREIGN PATENT DOCUMENTS

| | | | |
|---|---|---|---|
| 2741535 | 3/1979 | Fed. Rep. of Germany | 417/410 |
| 3104018 | 12/1981 | Fed. Rep. of Germany | 417/410 |

*Primary Examiner*—William L. Freeh
*Assistant Examiner*—Paul F. Neils
*Attorney, Agent, or Firm*—Michael J. Striker

[57] ABSTRACT

An arrangement for feeding a fuel particularly from a supply container to an internal combustion engine of a power vehicle, has a feeding pump with a feeding member rotatable about an axis, and a cylindrical pump chamber for the feeding member and having two chamber walls formed as separate members extending transverse to the axis and a tubular housing part retaining the chamber walls in a desired position wherein a further chamber wall surrounding the axis is formed by the tubular housing part.

8 Claims, 3 Drawing Figures

ARRANGEMENT FOR FEEDING FUEL, PARTICULARLY FROM SUPPLY CONTAINER TO INTERNAL COMBUSTION ENGINE OF A POWER VEHICLE

BACKGROUND OF THE INVENTION

The present invention relates to an arrangement for feeding a fuel, particularly from a supply container to an internal combustion engine of a power vehicle.

Arrangements of the above-mentioned general type are known in the art. A known arrangement has a pump chamber which is formed by ring-shaped axial projections formed at both chamber walls which extend transverse to the axis of rotation of a displacing or feeding member of the pump. For orderly abutting the ring-shaped end faces of both projections against one another, both structural members having these chamber walls are surrounded by a tubular housing part which is provided with the required means for securing against axial displacement of the structural members in the housing part. This construction of the pump chamber is relatively expensive inasmuch as the arrangement of the projections requires considerable manufacturing expenditures.

SUMMARY OF THE INVENTION

Accordingly, it is an object of the present invention to provide an arrangement for feeding a fuel, particularly from a supply container to an internal combustion engine of a power vehicle, which avoids the disadvantages of the prior art.

More particularly, it is an object of the present invention to provide an arrangement for feeding a fuel, particularly from a supply container to an internal combustion engine of a power vehicle, which is an improvement of and has a simpler construction than the known arrangements.

It is particularly an object of the present invention to provide an arrangement for feeding a fuel, particularly from a supply container to an internal combustion engine of a power vehicle, in which axial projections on both structural members can be dispensed with since their functions are taken by available tubular housing parts.

In keeping with these objects and with others which will become apparent hereinafter, one feature of the present invention resides, briefly stated, in an arrangement for feeding a fuel, particularly from a supply container to an internal combustion engine of a power vehicle, which has a feeding pump with a feeding member rotatable about an axis and means forming a cylindrical pump chamber in which the feeding member rotates, the means including two chamber walls formed as separate members and extending transverse to the axis of the feeding member, and a tubular housing wall retaining the chamber walls in a desired position, wherein there is a chamber wall which surrounds the axis and is formed by the above-mentioned tubular housing part.

When the arrangement is designed in accordance with the present invention, it attains the above-mentioned objects and provides for a simpler and less expensive construction.

In accordance with another feature of the present invention, in the arrangement including an electric drive motor with an electromagnetic pole tube and a rotor with an axis in alignment with the axis of the feeding member, the tubular housing part is formed as a metallic element connected with the pole tube.

Yet another feature of the present invention is that the tubular housing part in the arrangement of such type can be formed as an extension of the pole tube, and particularly as a one-piece extension of the pole tube of the electric motor.

A further feature of the present invention is that the tubular housing part is provided with at least two inwardly deflectable tongues in the region of the transverse chamber walls.

The inwardly deflectable tongues may be formed by U-shaped or H-shaped cutouts in the tubular housing part.

Yet a further feature of the present invention is that the transverse chamber walls are composed of a thermoplastic material, and the tongues of the tubular housing part are deformed under the action of heat and pressed inwardly.

Finally, at least one of the transverse chamber walls can be press fitted into the tubular housing part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
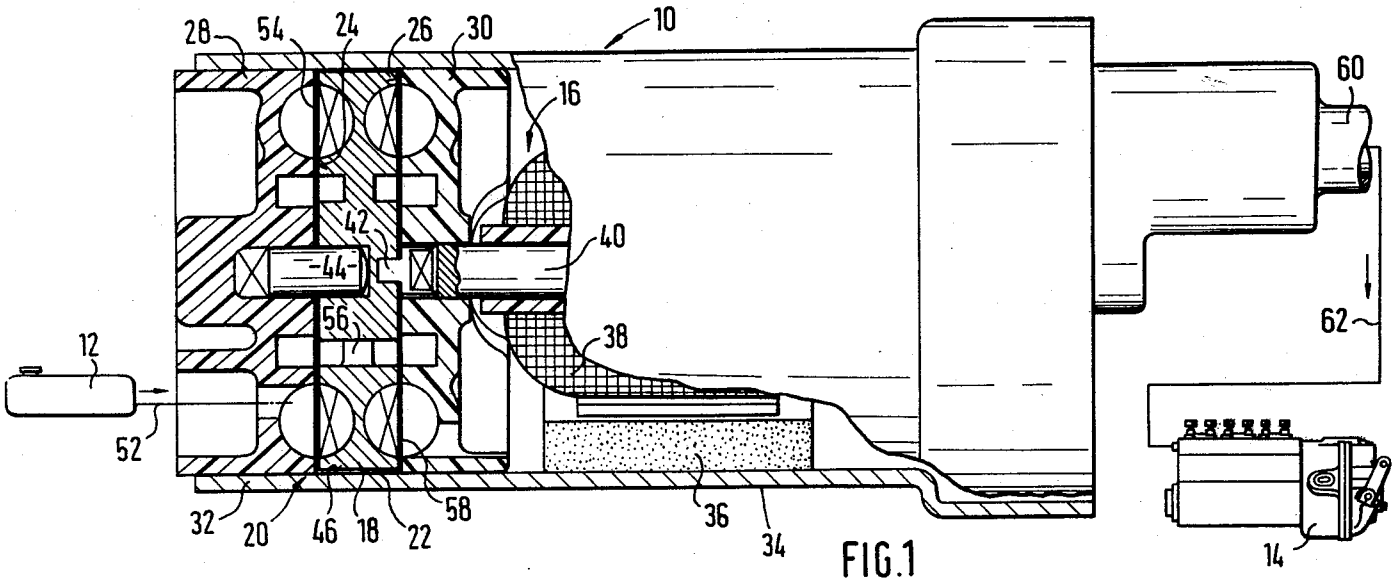
FIG. 1 is a view showing an arrangement for feeding a fuel, particularly from a supply container to an internal combustion engine of a power vehicle, in accordance with the present invention.

An arrangement for feeding a fuel, particularly from a supply tank to an internal combustion engine of a power vehicle, in accordance with the present invention is identified in toto by reference numeral 10. The supply container is identified by reference numeral 12, and the internal combustion engine is identified by reference numeral 14.

The arrangement has an electric drive motor 16 which drives in rotation a feeding or displacing member formed as a rotor 18 of a feed pump 20 in the direction of rotation. The rotor 18 is located in a pump chamber 22 which is substantially cylindrical. The pump chamber is limited by chamber walls 24 and 26 which extend transverse to the axis of rotation of the rotor 18. The wall 24 is arranged on a structural member 28 and the wall 26 is arranged on a structural member 30.

The structural members 28 and 30 are arranged in a tubular housing part 32. The arrangement has an electric drive motor 16 with a pole tube 34. The housing part 32 is formed as an extension of the pole tube 34. The electric drive motor 16 further includes permanent magnets 36 which surround an armature 38 and are arranged in the pole tube 34. The armature 38 is arranged on an armature shaft 40 which has an end provided with an entrainment member 42. The entrainment member 42 is formed complementary to the rotor 18 and takes it along when the armature 38 of the motor 16 rotates.

The support of the rotor 18 is performed by a pin 44 which is held in a rotation-fixed manner in the structural member 28. The shaft 40 of the armature 38 of the electric drive motor 16 is rotatably supported in the structural member 30. The housing part and the extension 32 of the pole tube 34 which serves as a magnetic lock forms a chamber wall 46. The chamber wall 46 approximately concentrically surrounds the axis of rotation of the feeding member 18 of the pump 20. The armature shaft 40 of the armature 38 of the drive motor 16 and the supporting pin 44 are in alignment with one another.

The pole tube 34 and its extension or housing part 32 are composed of a ferromagnetic material. Both structural members 28 and 30, however, are composed of a thermoplastic synthetic plastic material. Both structural members 28 and 30 are inserted in the housing part or extensions 32 of the pole tube 34 with play or pressure feed. The distance between the chamber walls 24 and 26 are so determined that the rotor 18 is arranged in the pump chamber 22 with a required axial play.

Figure 3:
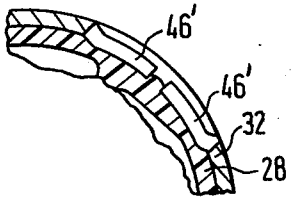
FIG. 3 is a view showing a section taken along the line III—III in the region of the arrangement illustrated in FIG. 2.
Figure 2:
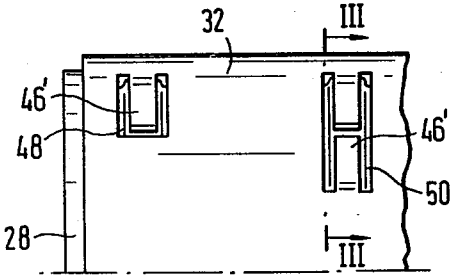
FIG. 2 is a view showing a portion of the arrangement of FIG. 1.

For mounting both structural members 28 and 30 in their predetermined position, the housing part or extension 32 of the pole tube 34 is provided with several inwardly deflectable tongues 46'. The tongues 46' are pressed inwardly under the action of heat in the structural members 28 and 30. The tongues 46' can be formed by U-shaped cutouts 48. It is also possible to provide a pair of tongues 46' by an H-shaped cutout 15, as shown in FIGS. 2 and 3. In this construction a simple and reliable fixing of the structural members 28 and 30 as well as the desired adjusted axial play are attained.

During the operation of the arrangement 10, it aspirates a fuel via an aspirating conduit 52 and supplies it first to a first pump step 54. The fuel flows via through openings 56 in the rotor 18 to a second pump step 58. Then the fuel flows from the second pump step 58 through the interior of the motor 16 to a discharge pipe 60 and via a pressure conduit 62 to the internal combustion engine 14.

It will be understood that each of the elements described above, or two or more together, may also find a useful application in other types of constructions differing from the types described above.

While the invention has been illustrated and described as embodied in an arrangement for feeding a fuel, particularly from a supply container to an internal combustion engine of a power vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed is:

1. An arrangement for feeding a fuel, particularly from a supply container to an internal combustion engine of a power vehicle, the arrangement comprising a feeding pump having a feeding member rotatable about an axis and means forming a cylindrical pump chamber in which said feeding member rotates, said pump chamber having an inlet and an outlet, said means including two chamber walls formed as separate members of a material deformable under pressure and extending transverse to said axis, and a tubular housing part retaining said chamber walls in a desired position, said means also including a further chamber wall surrounding said axis and formed by said tubular housing part, said tubular housing part having at least two inwardly deflectable tongues arranged, so that after said two members have been aligned within said tubular housing part said tongues are deflected radially inwardly and deform said members so as to hold the latter in such a position as to guarantee that the distance between said two chamber walls is sufficient for said feeding member to be arranged with axial play in said pump chamber.

2. An arrangement as defined in claim 1; and further comprising means for rotating said feeding member and including an electric drive motor having an electromagnetic pole tube and an armature with an axis in alignment with said axis of said feeding member, said tubular housing part being formed as a metallic element connected with said pole tube.

3. An arrangement as defined in claim 1, wherein said tubular housing part is provided with a U-shaped cutout which forms said inwardly deflectable tongues.

4. An arrangement as defined in claim 1, wherein said members are composed of a thermoplastic material.

5. An arrangement as defined in claim 1, wherein at least one of said transverse chamber wall is press fitted in said tubular housing part.

6. An arrangement as defined in claim 1; and further comprising means for rotating said feeding member and including an electric drive motor having an electromagnetic pole tube and an armature with an axis in alignment with said axis of said feeding member, said tubular housing part being formed as an extension of said pole tube.

7. An arrangement as defined in claim 6, wherein said tubular housing part of said feeding pump is formed as a one-piece extension of said pole tube of said electric motor.

8. An arrangement for feeding a fuel, particularly from a supply container to an internal combustion engine of a power vehicle, the arrangement comprising a feeding pump having a feeding member rotatable about an axis and means forming a cylindrical pump chamber in which said feeding member rotates, said pump chamber having an inlet and an outlet, said means including two chamber walls composed of a synthetic plastic material which is deformable under pressure and formed as separate members and extending transverse to said axis, and a tubular housing part retaining said chamber walls in a desired position, said tubular housing part having at least two inwardly deflectable tongues formed from an H-shaped cutout in said tubular housing part in the region of said transverse chamber walls, said means also including a further chamber wall surrounding said axis and formed by said tubular housing part.

* * * * *